United States Patent [19]

Nasatka et al.

[11] Patent Number: 4,850,737

[45] Date of Patent: Jul. 25, 1989

[54] HYDRAULIC SPRING VEHICLE BARRICADE AND HYDRAULIC CIRCUIT THEREFOR

[76] Inventors: Ralph G. Nasatka, 8405 Dangerfield Pl., Clinton, Md. 20735; James H. Smith, R.D. 1, Box 789 A, Mohnton, Pa. 19540

[21] Appl. No.: 191,774

[22] Filed: May 4, 1988

Related U.S. Application Data

[63] Continuation-in-part of Ser. No. 155,761, Feb. 16, 1988, abandoned.

[51] Int. Cl.[4] ..... E01F 13/00

[52] U.S. Cl. ..... 404/6; 49/33; 49/49; 49/131; 91/508; 60/477

[58] Field of Search ..... 404/6, 9–11; 14/71.3, 71.7; 49/33, 49, 131; 91/508; 60/477; 254/88, 89 H, 89 R

[56] References Cited

U.S. PATENT DOCUMENTS

| | | | |
|---|---|---|---|
| 2,187,513 | 1/1940 | Evans | 60/394 |
| 3,626,637 | 12/1971 | Rudicel | 49/25 |
| 3,748,782 | 7/1973 | Reynolds | 49/49 |
| 3,984,889 | 10/1976 | Blomgren | 14/71.7 |
| 4,091,488 | 5/1978 | Artzberger | 14/71.7 |
| 4,332,503 | 6/1982 | Hurst, Jr. | 404/11 |
| 4,354,771 | 10/1982 | Dickinson | 404/6 |
| 4,490,068 | 12/1984 | Dickinson | 404/6 |
| 4,627,763 | 12/1986 | Roemer et al. | 404/6 |
| 4,630,395 | 12/1986 | Nasatka | 49/49 |

FOREIGN PATENT DOCUMENTS

| | | | |
|---|---|---|---|
| 149963 | 7/1985 | European Pat. Off. | 49/49 |
| 2914708 | 10/1980 | Fed. Rep. of Germany | 404/6 |
| 8203450 | 4/1984 | Netherlands | 404/6 |
| 2165569 | 4/1986 | United Kingdom | 404/6 |

*Primary Examiner*—Jerome W. Massie, IV
*Assistant Examiner*—John F. Letchford
*Attorney, Agent, or Firm*—Shlesinger & Myers

[57] ABSTRACT

A vehicle barricade comprises a frame to which a barrier plate is pivotally mounted for being moved between a passage and a blocking position. First and second hydraulic motors operably interconnect the plate and the frame. An hydraulic power supply is operably connected with the hydraulic motors and includes an uninterrupted line for assuring constant power supply to the first hydraulic motor for thereby biasing the first hydraulic motor into extension and control valve means for selectively supplying power to the second motor for thereby causing selective pivoting of the plate.

25 Claims, 6 Drawing Sheets

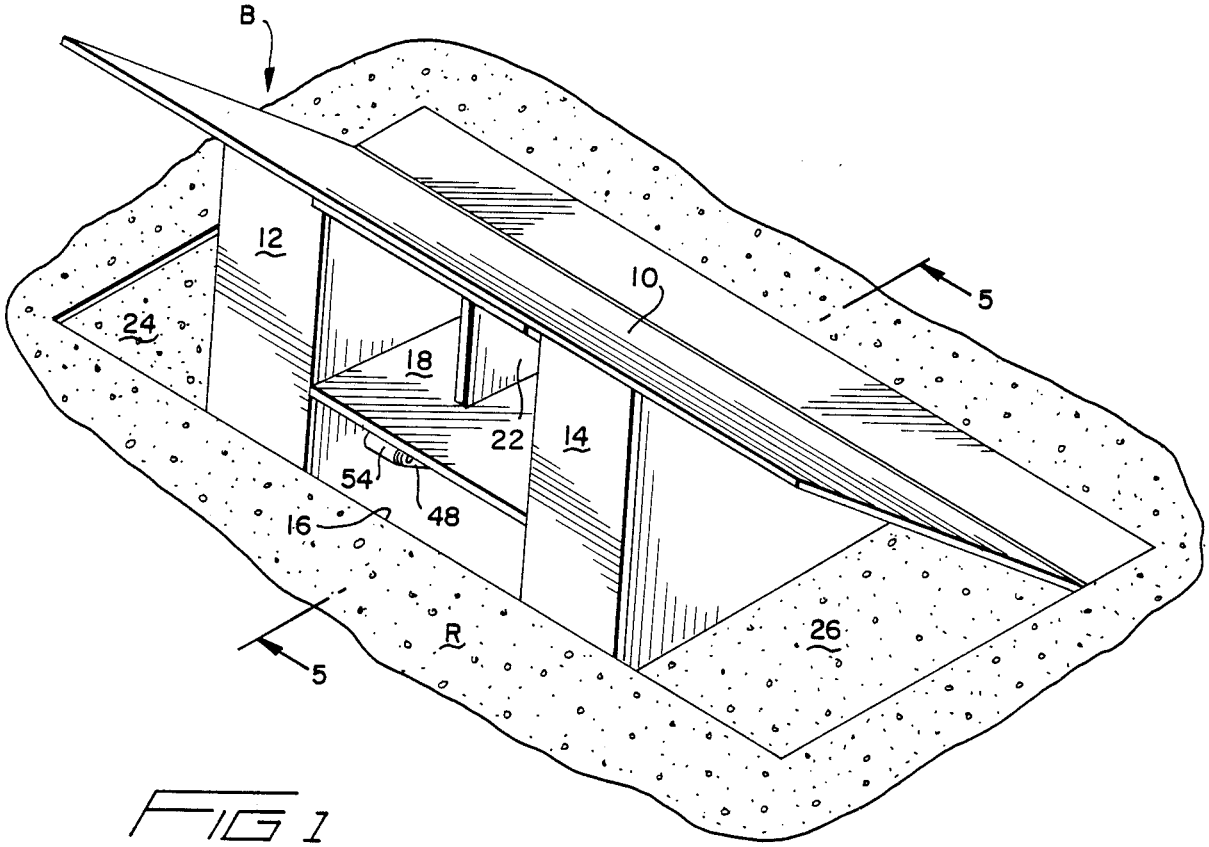
FIG 1
FIG 6
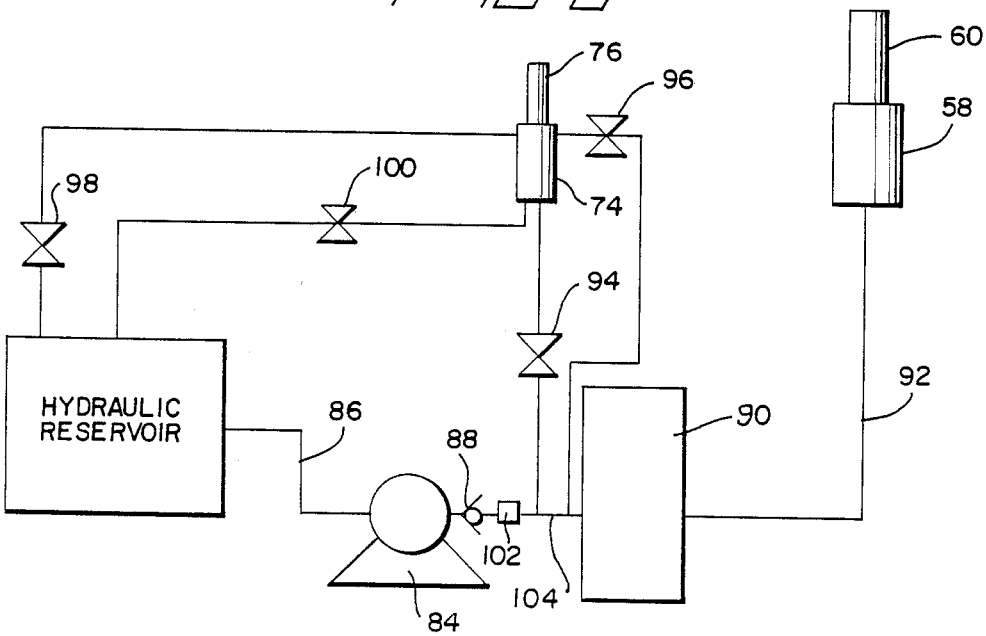

HYDRAULIC SPRING VEHICLE BARRICADE AND HYDRAULIC CIRCUIT THEREFOR

RELATED APPLICATIONS

This is a continuation-in-part of our prior application, Ser. No. 155,761, filed Feb. 16, 1988, now abandoned, for the invention entitled HYDRAULIC VEHICLE BARRICADE AND HYDRAULIC CIRCUIT THEREFOR.

BACKGROUND OF THE INVENTION

A vehicle barricade is a device disposed across a roadway or the like in order to control passage thereon. Typically, the barricade includes a barrier plate which is pivotal between a lowered, or passage permitting position, and a raised, or blocking position. The barrier plate is customarily manufactured from a heavy gauge steel and has substantial mass sufficient to withstand the impact of a speeding vehicle. It is preferred that the plate be rapidly pivotal between the two positions in order to provide the control required, as well as to not unnecessarily restrict traffic flow. Rapid pivoting, however, conflicts with the need for substantial mass.

The barrier plate is customarily pivoted by some sort of power system. Hydraulically operated systems are known. One disadvantage, however, of an hydraulically operated system is the need to overcome the weight of the plate for pivoting to occur. The barrier plate can weigh several thousand pounds, and it is therefore not unusual for the hydraulically powered system to utilize pressures of several thousand pounds. Those skilled in the art will understand that such high operating pressures are not desirable because of safety concerns, the need for special or expensive pumps or motors, and the like.

From the above, it can be seen that there is a need for a vehicle barricade which has a rapidly pivotal plate operated through a relatively low pressure hydraulic system. The low pressure system must, however, ensure that the plate can be rapidly pivoted between the positions even though the plate has sufficient mass to withstand the impact of a speeding vehicle. The disclosed vehicle barricade meets these needs, and utilizes an hydraulic system creating an hydraulic spring.

OBJECTS AND SUMMARY OF THE INVENTION

The primary object of the disclosed invention is a vehicle barricade having a plate of substantial mass which may be rapidly pivoted between the lowered and raised positions in response to a relatively low pressure hydraulic operating system.

The vehicle barricade of the invention comprises a frame. A barrier plate is pivotally mounted to the frame for being moved between a passage and a blocking position. First and second hydraulic motor means are operably connected to the plate. An hydraulic power supply means includes first means for assuring constant power supply to the first motor means for thereby biasing the barrier plate into the blocking position and second means for selectively supplying power to the second motor means for causing pivoting of the plate into the passage position.

A traffic controller according to the invention comprises an open topped frame disposed below a surface to be controlled. A barrier plate is pivotally mounted to the frame for covering the top thereof in order to allow traffic to pass therealong, and for being pivoted relative thereto for preventing traffic from passing therealong. First and second hydraulic motor means are provided, and each of the motor means has a first portion operably connected to the frame and a second extensible portion operably connected to the plate. An hydraulic power supply means is operably connected to each of the motor means and includes first means for assuring constant power supply to the first motor means so that the first motor means extensible portion is biased into extension and second means for selectively supplying power to the second motor means for causing selective pivoting of the plate.

An hydraulic system for a vehicle barricade comprises a reservoir for storing hydraulic fluid. A pump has an inlet and an outlet and the inlet is operably connected to the reservoir. An accumulator means for storing pressurized hydraulic fluid is operably connected with the outlet and includes valve means for preventing pressurized fluid from flowing from the accumulator means to the pump. First and second hydraulic motor means are provided, and each motor means has an extensible portion for operable connection with the barrier plate. An uninterrupted line interconnects the accumulator means and the first, motor means for assuring constant supply of pressurized fluid thereto so that the first motor means biases the barrier plate into the blocking position. First and second control valve means operably interconnect the outlet, the second motor means and the reservoir for causing selective extension and retraction of the second motor means extensible portion and thereby pivoting of the barrier plate into the lowered position.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a perspective view of the barricade of the invention with the barrier plate in the raised position;

FIG. 6 is a schematic view illustrating the hydraulic system of the invention;

DESCRIPTION OF THE INVENTION

Barricade B, as best shown in FIG. 1, is disposed across roadway R for controlling the passage of vehicles therealong. Barricade B includes a barrier plate 10 pivotal between the raised position illustrated in FIG. 1 and the lowered position illustrated in FIG. 2. Those skilled in the art will understand that the plate 10 prevents passage of vehicles along the roadway R when in the raised position of FIG. 1, while permitting passage of vehicles when in the lowered position of FIG. 2.

The barricade B is constructed substantially in accordance with that of the copending application of Ralph G. Nasatka, filed September 4, 1987 under Serial No.: 093,203 for Underground Vehicle Barricade, the disclosure of which is incorporated herein by reference. The system for pivoting the plate 10, however, is different from that disclosed in the copending application as will be apparent.

Figure 4:
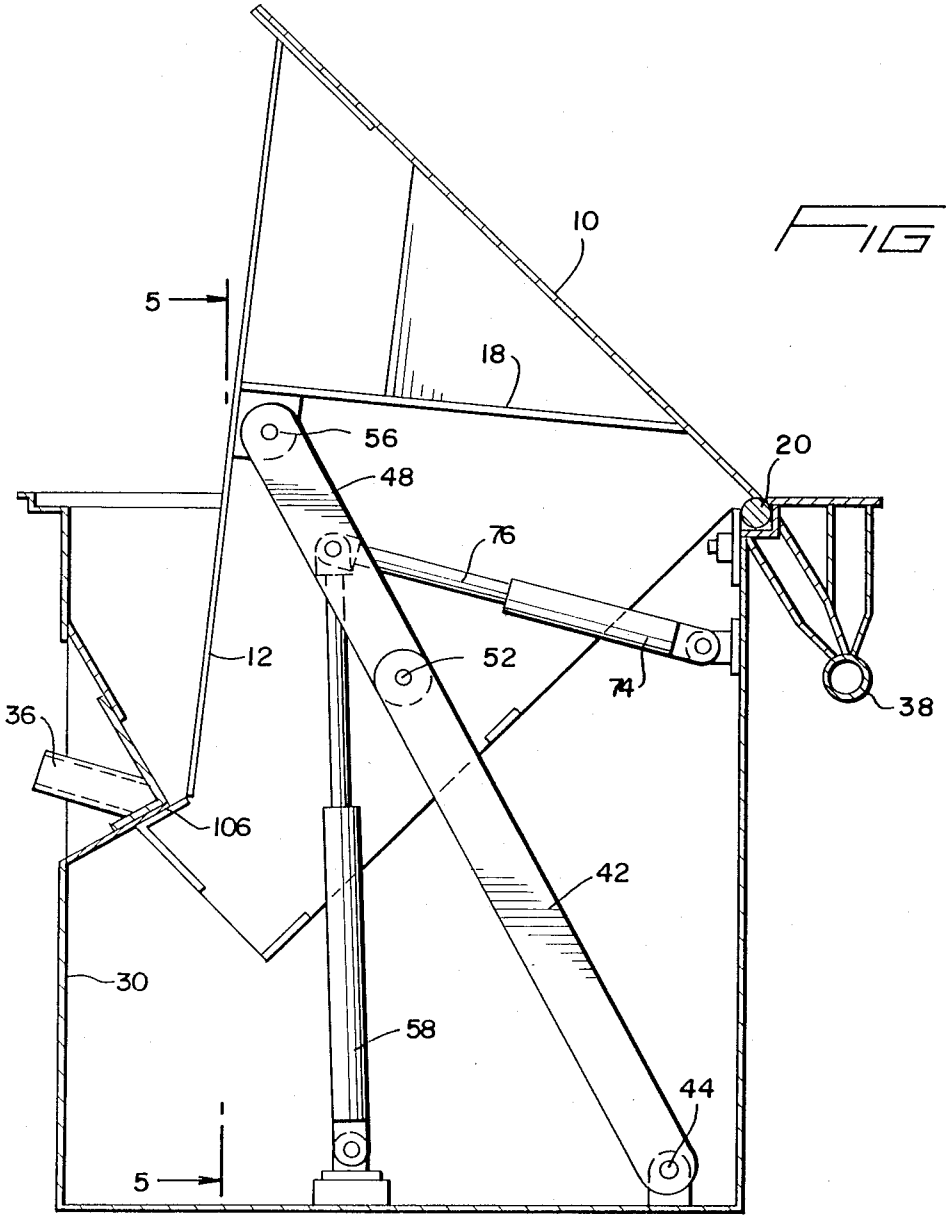
FIG. 4 is a cross-sectional view illustrating the barrier plate in the raised position of FIG. 1.

Structural supports 12 and 14 are carried by the plate 10 and prevent entrance to pit 16, while also providing additional support to withstand a vehicle impact from the front or the side. Reenforcing plate 18 is secured to and extends between supports 12 and 14 and is angularly disposed relative to the plate 10 in order to cause an impacting vehicle to be directed downwardly towards pivoting shaft 20, as best shown in FIG. 4. An additional support 22 is secured to and extends between reenforcing plate 18 and barrier plate 10 and assists in destroying an impacting vehicle. It can be noted in FIG. 1 that the plate 10 has substantial length and extends laterally beyond supports 12 and 14. Recesses 24 and 26 are provided in roadway R for receiving the extensions of the plate 10 when the barricade B is in the lowered position of FIG. 2.

As noted, the structural supports 12 and 14 extend into pit 16 disposed within concrete C below roadway R. The pit 16 is, preferably, lined with steel plates in order to define sidewalls 28 and 30, as well as a bottom wall 32. Naturally, there are also provided sidewalls extending parallel to the direction of passage along roadway R, only the sidewall 34 being illustrated in FIG. 2. Those skilled in the art will appreciate that the interconnected side and bottom walls form an open topped frame set into the concrete C. Naturally, as disclosed in the prior application of Ralph G. Nasatka referred to above, anchors 36 and 38 are secured to the appropriate sidewalls 30 and 28, respectively, in order to resist any tendency of the barricade B to rotate out of the pit 16 upon being subject to an impact.

Figure 5:
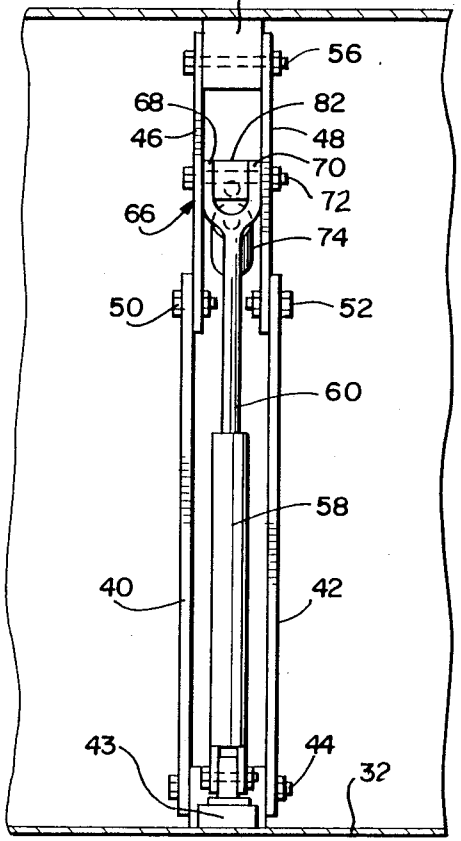
FIG. 5 is a fragmentary cross-sectional view taken along the Section 5—5 of FIG. 4, and viewed in the direction of the arrows.

Links 40 and 42, as best shown in FIG. 5, are connected through mount 43 to bottom wall 32 and pivot about an axis defined by shaft 44. Second links 46 and 48 have a first end portion pivotally connected to the links 40 and 42, respectively, through bolts 50 and 52, respectively. The second end portions of the links 46 and 48 are connected to block 54 secured to reinforcing plate 18 and pivot about an axis defined by bolt 56. In this way, the interconnected links 40, 46 and 42, 48 provide a linkage assembly which is used to pivot the plate 10 between the lowered and raised positions.

A first hydraulic motor M1 is provided by cylinder 58 and piston 60 and is disposed within the frame. The cylinder 58 pivots about shaft 62 operably connected with mount 64. It can be noted in FIG. 2 that the mount 64 is nearer the sidewall 30 than is the shaft 44 of the links 40 and 42. We have found that best results are obtained when the shaft 44 is relatively close to the sidewall 28 and the mount 64 is at least midway the sidewalls 28 and 30.

Piston 60 terminates in a clevis 66 having spaced arms 68 and 70 pivotally secured to the links 46 and 48, respectively, through bolt 72.

A second hydraulic motor M2 is provided by the cylinder 74 and piston 76. The cylinder 74 is pivotally connected to block 78 through bolt 80. The piston 76, as best shown in FIG. 5, terminates in a cylindrical member 82 disposed transverse to piston 76 and having an aperture through which the bolt 72 passes. In this way, the cylindrical member 82 extends between the arms 68 and 70 and is free to pivot about the bolt 72. Those skilled in the art understand, therefore, that the cylinders 60 and 76 both have end portions which pivots about the common axis defined by bolt 72.

We have found that a mechanical advantage is achieved by the interconnected links 40, 46 and 42, 48 and is sufficient to permit the barrier plate 10 to be rapidly pivoted through the cooperative action of the two disclosed hydraulic motor means M1 and M2. It can be noted in FIG. 5 that both cylinders 58 and 74 are disposed between the interconnected links 40, 46 and 42, 48, so that the spaced parallel link assemblies are therefore caused to pivot simultaneously, and in a manner which precludes canting or tipping as could be caused with separate linkage assemblies operated upon by separate hydraulic motors. Furthermore, because of bolts 50 and 52, the pistons 60 and 76 may move between the parallel link asemblies.

We have found that best results are achieved when the bolt 80 is disposed above the bolt 72 when the plate 10 is in the lowered position. It can be noted in FIGS. 2 through 4, that the mount 78 and the bolt 80 are closer to the top of sidewall 28 than the bottom wall 32. Positioning of the mount 78 relatively close to the top of sidewall 28 permits a relatively short cylinder 74 and piston 76 to be utilized, while also making maximum usage of the mechanical advantage achieved by the linkage system.

We have found that the cylinder 58 and piston 60 should be relatively large in length as compared to the cylinder 74 and piston 76. This is due, in part, to the provision of relatively short links 46 and 48 as compared to the links 40 and 42. Also, the cylinder 58 and piston 60 must have substantial length because of their connection to bottom wall 32, and the positioning at almost the midpoint between the sidewalls 28 and 30.

The hydraulic system for operating the motor means M1 and M2 used for pivoting the plate 10 is disclosed in FIG. 6. An hydraulic reservoir is connected to motor driven pump 84 through piping or line 86. The outlet of pump 84 has a check valve 88 in order to prevent pressurized hydraulic fluid from flowing from accumulator 90 into the pump 84. The cylinder 58 is connected to the accumulator 90 through line 92 which is uninterrupted in order to assure that pressurized hydraulic fluid from the accumulator 90 is always being supplied to the cylinder 58. Therefore, cylinder 58 and the piston 60 are always being pressurized, or biased, into the extended or barrier plate blocking position, much like a spring under tension.

Valves 94 and 96 interconnect the outlet of pump 84 to the cylinder 74 in order to cause extension and retraction of the piston 76. Naturally, valves 98 and 100 interconnect the cylinder 74 with the hydraulic reservoir and cooperate with the valves 94 and 96 in order to facilitate extension and retraction of the piston 76.

Those skilled in the art will understand that while individual valves 94, 96, 98 and 100 are illustrated, the system could easily be fabricated with a conventional hydraulic block, so that only two solenoid valves need be provided for appropriately directing the pressurized hydraulic fluid during extension and retraction of the piston 76. A low pressure valve 102 may be provided in the line 104 interconnecting the outlet of pump 84 with accumulator 90 in order to activate the pump 84 in the event of a low pressure causing condition.

Those skilled in the art will understand that the cylinder 58 operates as a one way cylinder because there is no line interconnecting the opposite end of the cylinder 58 to the reservoir. We have found that this hydraulic one way cylinder acts as an hydraulic spring when used in conjunction with the double acting cylinder 74. The application of constant pressure to the cylinder 58 through accumulator 90 causes the piston 60 to be biased towards extension or barrier plate blocking, thereby constantly attempting to pivot the plate 10 into the blocking position of FIG. 1. This biasing may also be thought of as an hydraulic counterweight, although we believe that the comparison with a spring is more relevant because of the tendency of the piston 60 to be extended, thereby resisting the weight of the plate 10 and its related structural assemblies.

From the above, it can be appreciated that the cylinder 58 and piston 60 do not alone have sufficient force to displace the plate 10, but merely have sufficient force to counteract the weight of the plate 10. The relatively small piston 76 can accomplish the pivoting of the plate 10 because it need only overcome the inertia of plate 10, the weight being accommodated by the piston 60. The piston 76 can therefore pivot the plate 10 between the lowered position of FIG. 2 and the raised position of FIG. 4. We have found that it is sufficient to utilize a pressure of 1700 psi for operating the pistons 60 and 76, as opposed to the several thousands pounds or more used in conventional systems. We can reduce the operating pressure because of the spring-like action of the cylinder 74 and the mechanical advantage achieved by the linkage assembly.

Figure 2:
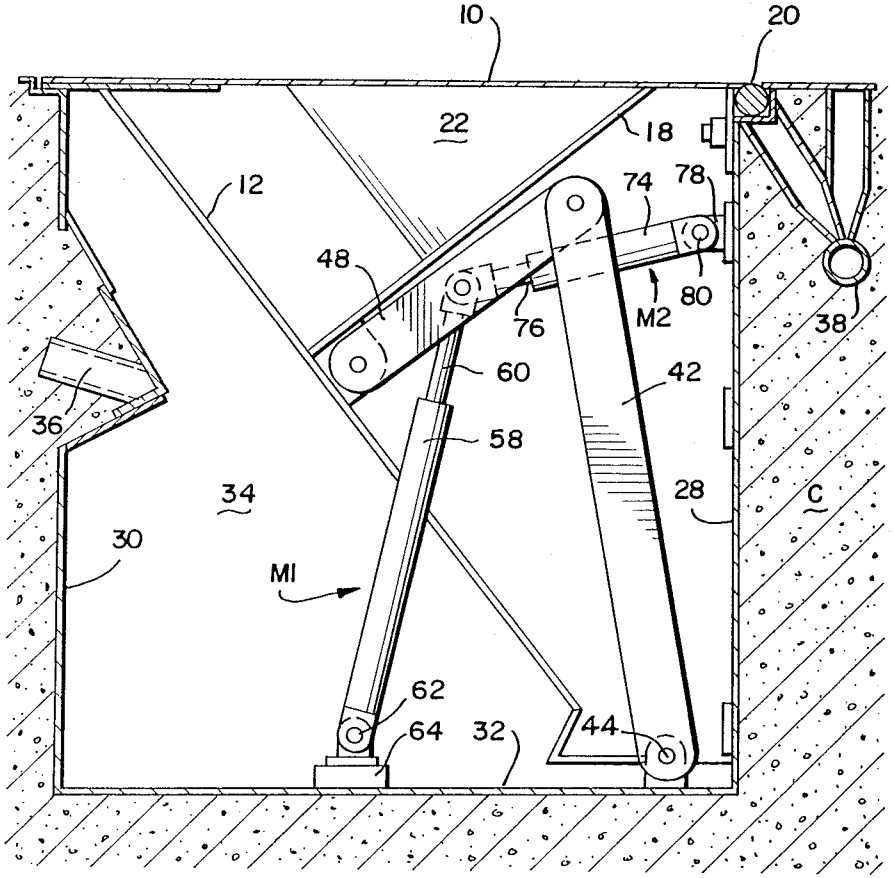
FIG. 2 is a cross-sectional view illustrating the barrier plate of the invention in the lowered position.

It can be noted in FIG. 2 that the link 42 extends almost vertical with regard to the sidewall 28 when the plate 10 is in the lowered position. Similarly, the cylinder 58 leans toward the link 42 while the cylinder 74 and link 48 extend downwardly, although somewhat at an angle to each other.

Figure 3:
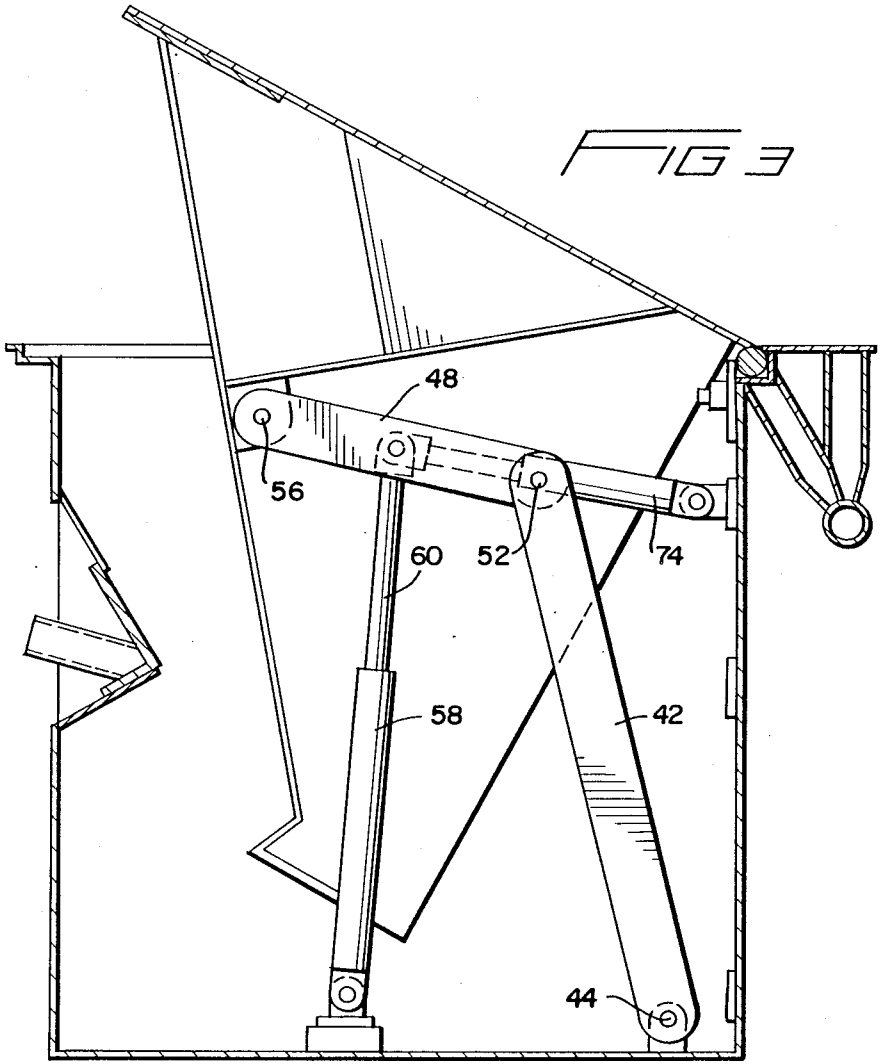
FIG. 3 is a cross-sectional view similar to that of FIG. 2 with the barrier plate intermediate the raised and lowered positions.

Extension of the piston 76, as best shown in FIG. 3, causes the link 42 to be pivoted toward the sidewall 31, while the cylinder 58 likewise pivots towards the vertical. At the same time, the cylinder 74 and the link 48 begin to pivot upwardly so that, in the intermediate position of FIG. 3, the piston 76 is almost parallel with the link 48.

Continued extension of the piston 76, as best shown in FIG. 4, causes the links 42 and 48, and also the links 40 and 46, to be disposed in longitudinal alignment. It can be noted in FIG. 4 that the cylinder 58 attains a substantially vertical position, while the cylinder 74 is disposed upwardly but at an angle to the links 48 and 46.

FIG. 4 discloses that the structural support 12 has a stop 106 which engages the anchor 36 of sidewall 30. An impacting vehicle will attempt to rotate the plate 10 in a clockwise direction, with the result that the stop 106 transfers the impacting force to the anchor 36, and thereby to the concrete C. Similarly, the impacting force is transferred by shaft 20 to the anchor 38, and thereby into the concrete C. The cylinders 58 and 74 do not, therefore, absorb any of the impact force, and may be sized merely to accomplish their pivoting functions, thereby avoiding the necessity of being sized for impact absorption functions.

We have found that the hydraulic system of FIG. 6 operates best when the pump 84 is caused to operate only when the plate 10 is being pivoted into the raised position. When the piston 76 is to be retracted, for thereby lowering the plate 10, then it is merely necessary to open the valves 96 and 100 and to allow the accumulator pressure to cooperate with the weight of the plate 10 for lowering the plate 10. This minimizes the capacity of the accumulator 90, and also reduces the operating requirements on the pump 84. Furthermore, the action of the piston 70 as an approximation of a spring is therefore enhanced because just like a spring, application of pressure causes the spring to expand, while the diminishment of pressure causes the spring to retract.

Figure 9:
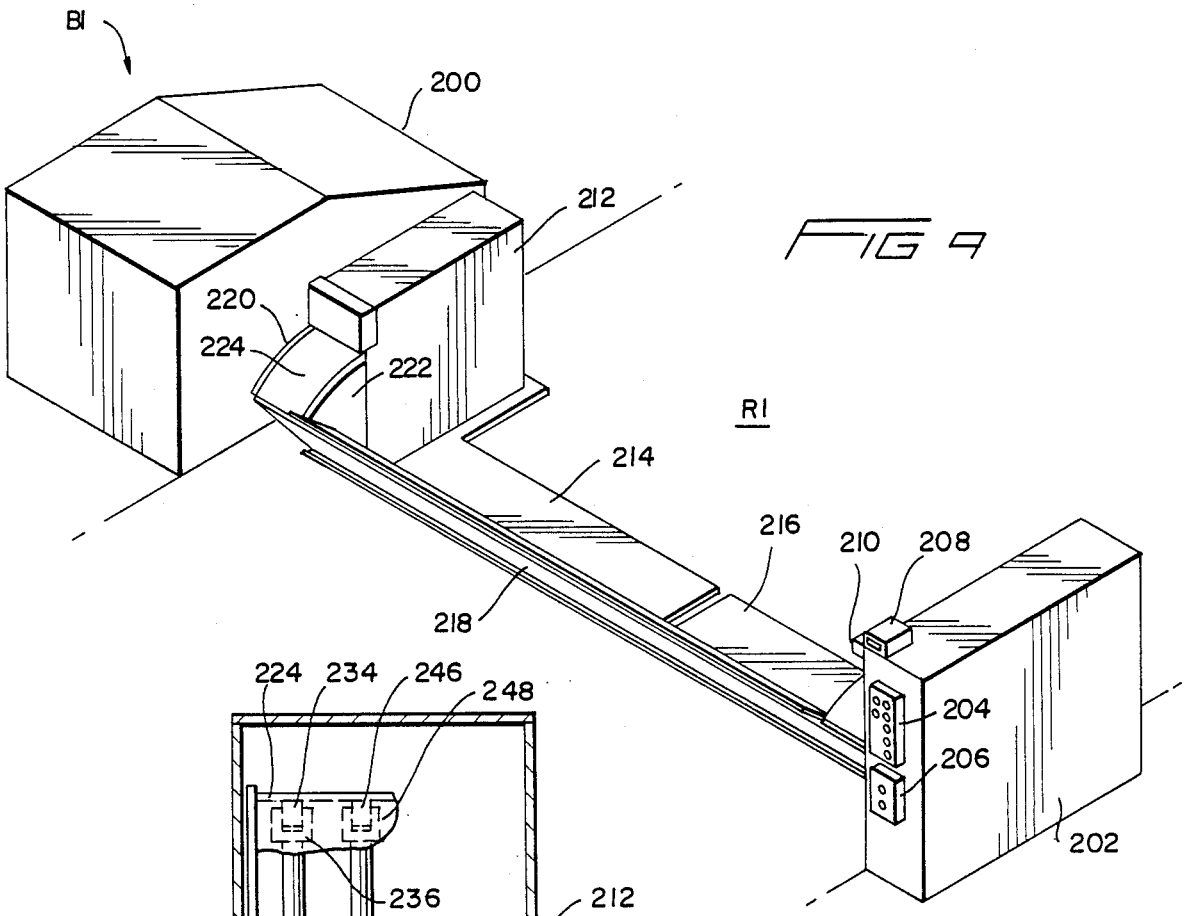
FIG. 9 is a cross-sectional view, taken along the line 9—9 of FIG. 8; and, FIG. 10 is a perspective view of the barricade of FIGS. 7–9.

The barricade B1, as best shown in FIG. 9, is constructed essentially as that disclosed in U.S. Pat. No. 4,630,395, issued Dec. 23, 1986, to Ralph G. Nasatka for PORTABLE VEHICLE BARRICADE OR PORTABLE MAXIMUM SECURITY BARRIER, the disclosure of which is incorporated herein by reference.

The barricade B1 has a housing 200 which surrounds the motor, hydraulic reservoir and accumulator, as well as related items, of the hydraulic system of FIG. 6. A spaced control housing 202 has a control instrumentation panel 204, as well as a vehicle signal means 206. Also mounted to the control housing 202 is a vehicle identification monitor 208 and a vehicle detector 210 for detecting the presence of a vehicle.

Housing 212 is positioned adjacent housing 200. A similar housing is also provided adjacent the control housing 202 as disclosed in U.S. Pat. No. 4,630,395. Plates 214 and 216 are secured to roadway R1. The housing 212 is mounted to and extends from the plate 214, as does the associated housing adjacent the control housing 202. Preferably, barrier plate 218 is pivotally mounted to the plates 214 and 216 and thereby extends between housing 212 and the housing adjacent control housing 202.

The barrier plate 218 includes side supports 220 and 222 which extend therefrom into the housing 212. Similar side supports are provided for the housing adjacent control housing 202. A cover plate 224 extends between the side supports 220 and 222 in order to prevent access to the interior of housing 212 when the barrier plate 218 is in the lowered or passage position.

Cylinder 226 has an end portion thereof pivotally mounted to bracket 228 in order to permit rotation about shaft 230. The piston 232 thereof is pivotally connected to cover plate 224 through bracket 234. The piston 232 may include a clevis 236 for cooperating with the bracket 234 in order to permit rotation about a common shaft thereof.

A second cylinder 238 has the end portion thereof pivotally mounted to bracket 240 for rotation about pin 242. The piston 244 thereof is pivotally mounted to bracket 246 through clevis 248. Those skilled in the art will appreciate that positioning the cylinders 226 and 238 and their respective pistons 232 and 244 within the housing 212 prevents access thereto because of the security provided by the side supports 220 and 222 in combination with the cover plate 224.

Figure 10:
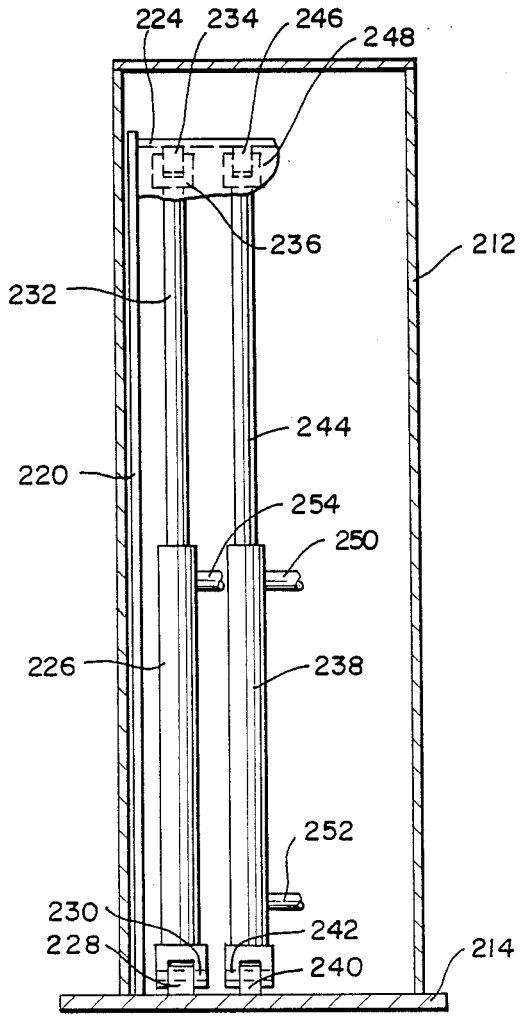

It can be noted in FIG. 10 that the cylinder 238 has hydraulic lines 250 and 252 in order to permit extension and retraction of the piston 244 as may be required. The cylinder 226, on the other hand, is a one way cylinder because there is a single hydraulic supply line 254 provided. The hydraulic line 254 biases the piston 232 towards retraction, for thereby causing the barrier 218 to attempt to pivot into the blocking position.

Figure 7:
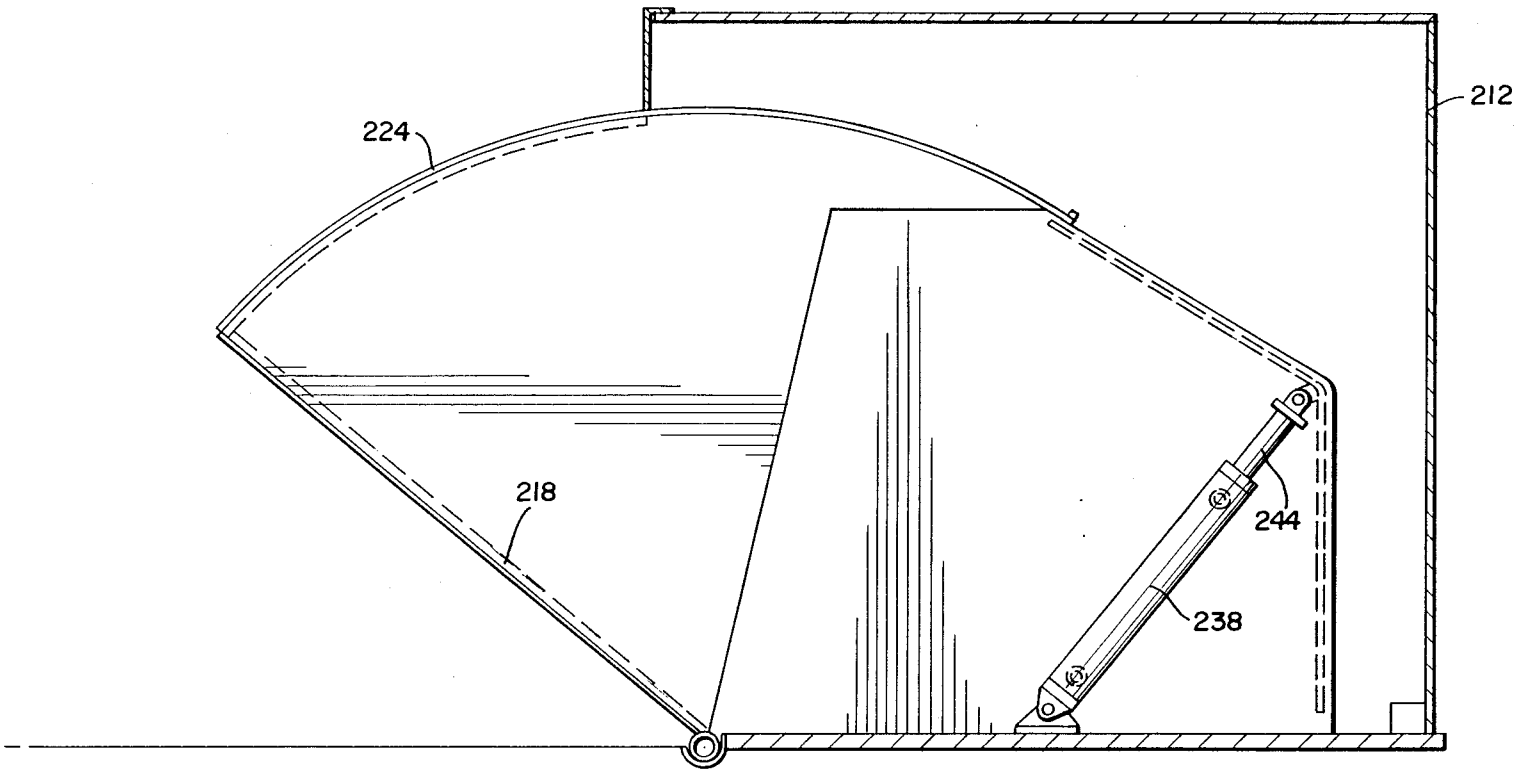
FIG. 7 is a cross-sectional of an above ground barricade according to the invention and with the barrier plate in the raised position.
Figure 8:
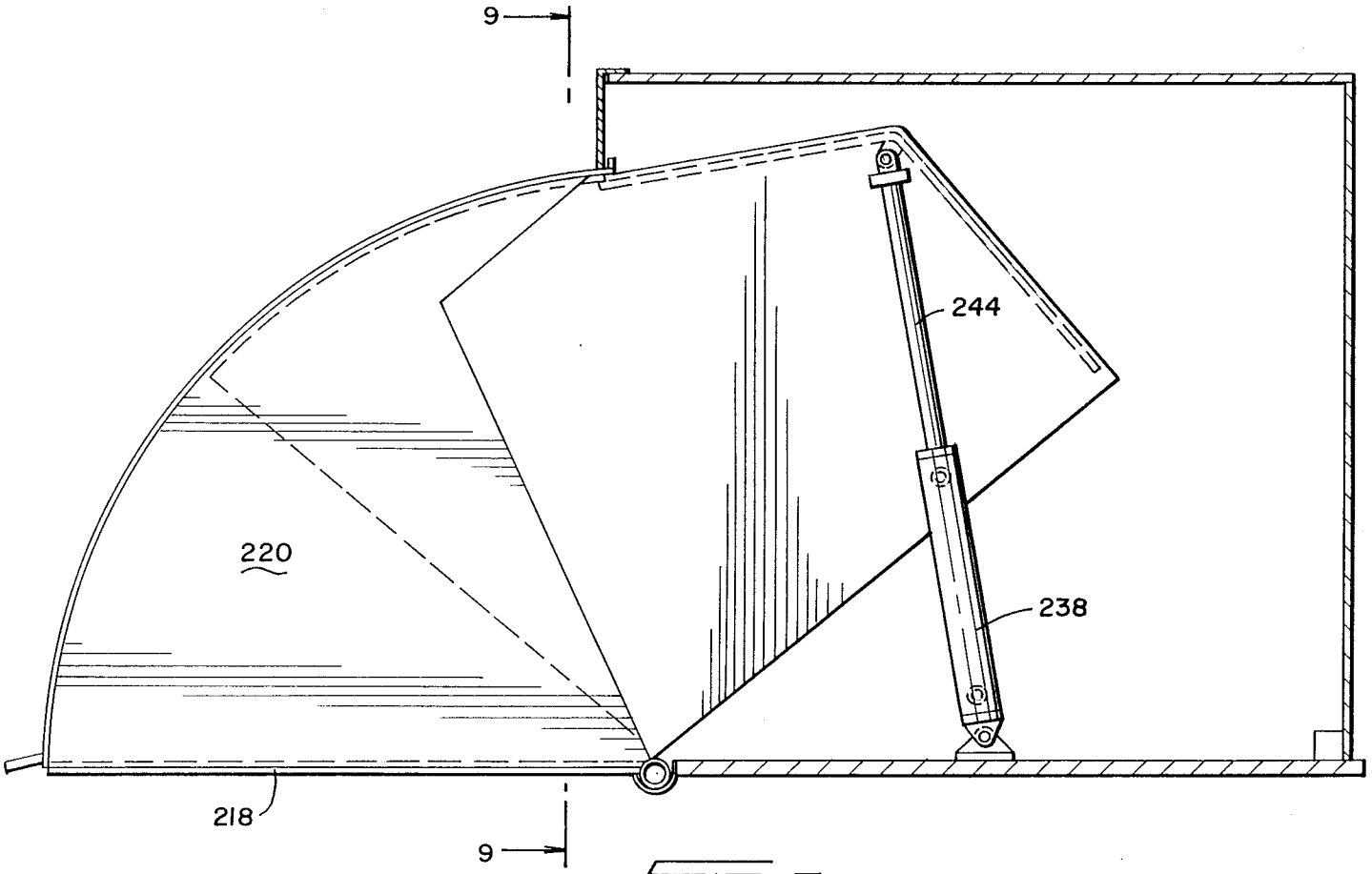
FIG. 8 is of the barricade of FIG. 7 with the barrier plate in the lowered position.

FIG. 7 discloses the barrier plate 218 in the raised or blocking position. It can be noted that the piston 244 is retracted in this position, in order to cause the appropriate pivoting of the plate 218. FIG. 8 discloses that the piston 244 is extended when the barrier plate 218 is in the lowered or passage position.

The barricade B1 of FIG. 9 is easily adapted for operation with the hydraulic system of FIG. 6. In the aboveground configuration of FIG. 9, it is merely necessary that the hydraulic system of FIG. 6 bias the piston 232 towards retraction in order to cause the barrier plate 218 to be biased towards being pivoted into the blocking position. As with the embodiment of FIG. 1, the biasing cylinder 226 has insufficient force to cause the plate 218 to be pivoted into the blocking position, therefore necessitating appropriate application of pressurized hydraulic fluid to the cylinder 238. The biasing action of the cylinder 226 is sufficient, however, to once again cause the barricade B1 to have the attributes of an hydraulic spring, as well as the previously noted benefits and advantages.

FIG. 10 discloses that the cylinders 226 and 238, as well as their respective pistons 232 and 244, are disposed in spaced parallel relation within the housing 212. The pins 230 and 242 preferably define a common axis about which the cylinders 226 and 238, respectively, pivot. This assures optimum force action. We have found that pivoting of the barrier plate 218 through utilization of the cylinders 226 and 238 is sufficient, and it is not necessary for corresponding cylinders to be provided in the housing adjacent the control housing 202.

While this invention has been disclosed has having a preferred design, it is understood that it is capable of further modifications, uses and/or adaptations of the invention following in general the principle of the invention and including such departures from the present disclosure as come within known or customary practice in the art to which the invention pertains, and as may applied to the central features herein before set forth, and fall within the scope of the invention of the limits of the appended claims.

What we claim is:

1. A vehicle barricade, comprising:

(a) a frame;

(b) a barrier plate pivotally mounted to said frame for being moved between a passage and a blocking position;

(c) first and second hydraulic motor means operably connected to said plate; and, (d) hydraulic power supply means including first means for assuring constant power supply to said first motor means for biasing said first motor means so that said barrier plate is biased toward said blocking position and second means for selectively supplying power to said second motor means for causing pivoting of said plate into said passage position.

2. The barricade of claim 1, wherein:

(a) each of said motor means has a first portion operably connected to said frame and a second extensible portion operably connected to said plate.

3. The barricade of claim 2, wherein:

(a) said frame includes a first substantially vertical sidewall and a first substantially horizontal bottom wall extending generally transverse therefrom; and, (b) said first motor means first portion is operably connected to said bottom wall and said second motor means first portion is operably connected to said frame.

4. The barricade of claim 1, wherein:

(a) link means operably interconnect and extend between said frame and said barrier plate; and, (b) each of said motor means has a first portion operably connected to said frame and a second extensible portion operably connected to said link means.

5. The barricade of claim 4, wherein:

(a) said plate is pivotal about a shaft disposed proximate a first sidewall of said frame; and, (b) said link means are connected to said plate proximate a second opposite sidewall of said frame.

6. The barricade of claim 4, wherein said link means includes:

(a) at least first and second pivotally interconnected links;

(b) said first link having a first end portion pivotally connected to said frame;

(c) said second link having a first end portion pivotally connected to said plate; and, (d) each of said links has a second end portion and said second end portions are pivotally connected.

7. The barricade of claim 6, wherein:

(a) each second portion of said motor means is pivotally connected to said second link.

8. The barricade of claim 7, wherein:

(a) each second portions of said motor means is pivotal about a common axis disposed intermediate the second link end portions.

9. The barricade of claim 8, wherein:

(a) said frame is disposed below a surface to be controlled and has a first substantially vertical sidewall and a first substantially horizontal bottom wall; and, (b) said first motor means first portion is pivotally connected to said bottom wall and said second motor means first portion is pivotally connected to said sidewall.

10. The barricade of claim 9, wherein:

(a) said second motor means first portion is pivotal about a first axis disposed above said common axis when said plate is in said passage position and below said common axis when said plate is in said blocking position.

11. The barricade of claim 8, wherein:

(a) there being a pair of first and second links, and each link being disposed in spaced parallel relation relative to an associated link; and, (b) each second portion of said motor means is pivotally connected to each of said second links.

12. The barricade of claim 11, wherein:

(a) said first motor means second portion includes a clevis having a pair of spaced arms and each of said arms is connected to one of said second links; and, (b) said second motor means second end portion includes a cylindrical member received between said arms.

13. A traffic controller, comprising:
(a) an open topped frame disposed below a surface to be controlled;
(b) a barrier plate pivotally mounted to said frame for covering the top thereof in order to allow traffic to pass therealong and for being pivoted relative to said frame for preventing traffic from passing therealong;
(c) first and second hydraulic motor means, each of said motor means has a first portion operably connected to said frame and a second extensible portion operably connected to said plate; and,
(d) hydraulic power supply means are operably connected to each of said motor means and includes first means for assuring constant power supply to said first motor means so that said first motor means is biased into extension and second means for selectively supplying power to said second motor means for thereby causing pivoting of said plate.

14. The controller of claim 13, wherein:
(a) said frame includes a first substantially vertical sidewall and a first substantially horizontal bottom wall extending generally transverse thereto; and,
(b) said first motor means first portion is pivotally connected to said bottom wall and said second motor means first portion is pivotally connected to said sidewall proximate the top thereof.

15. The controller of claim 14, wherein:
(a) first and second links are disposed in spaced parallel relation relative to each other and each has a first end portion pivotally connected to said bottom wall intermediate said first motor means and said side wall and a second end portion proximate said plate;
(b) third and fourth links are disposed in spaced parallel relation and each has a first end portion pivotally connected to the second end portion of one of said first and second links and a second end portion pivotally connected to said plate; and,
(c) the second portion of each of said motor means is pivotally connected to said third and fourth links.

16. The controller of claim 15, wherein:
(a) said first and second motor means are disposed between said first and second, and third and fourth links; and,
(b) said motor means second portions pivot about a common axis intermediate the end portions of said third and fourth links.

17. The controller of claim 16, wherein:
(a) said first motor means second portion includes a clevis having spaced arms connected to said third and fourth links; and,
(b) said second motor means second portion includes a cylindrical member extending between said arms.

18. The controller of claim 13, wherein said power supply means includes:
(a) a reservoir for storing hydraulic fluid;
(b) a pump operably connected to said reservoir;
(c) an accumulator means operably connected to said pump for receiving pressurized hydraulic fluid and including means for preventing hydraulic fluid from flowing from said accumulator to said pump;
(d) an uninterrupted line interconnecting said first motor means and said accumulator for biasing said first motor means into extension; and,
(e) valve means interconnect said pump, said second motor means and said reservoir for controlling pivoting of said plate.

19. The controller of claim 13, wherein:
(a) said first motor means is a single acting hydraulic cylinder and piston assembly; and,
(b) said second motor means is a double acting hydraulic cylinder and piston assembly.

20. An hydraulic system for a vehicle barricade, comprising:
(a) a reservoir for storing hydraulic fluid;
(b) a pump having an inlet and an outlet and said inlet operably connected to said reservoir;
(c) accumulator means for storing pressurized hydraulic fluid operably connected with said outlet and includes valve means for preventing pressurized fluid from flowing from said accumulator means to said pump;
(d) first and second hydraulic motor means, each motor means has an extensible portion for operable connection with a barricade plate;
(e) an uninterrupted line interconnects said accumulator means and said first motor means for assuring the constant supply of pressurized fluid thereto for thereby biasing said extensible portion and the barrier plate into blocking position; and,
(f) first and second control valve means operably interconnect said outlet, said second motor means and said reservoir for causing selective extension and retraction of said second motor means extensible portion.

21. A vehicle barricade, comprising:
(a) a frame;
(b) a barrier plate pivotally associated with said frame and having a raised blocking position and a lowered passage position;
c) first and second hydraulic motor means, each motor means has a first portion operably connected to said frame and a second extensible portion operably connected to said plate; and,
(d) hydraulic power supply means operably connected to said motor means for supplying pressurized hydraulic fluid thereto so that said first hydraulic motor means is continuously biased for causing biasing of said plate into said blocking position and said power supply means further includes valve means for causing selected operation of said second motor means and thereby pivoting of said plate.

22. The barricade of claim 21, wherein:
(a) said first and second motor means first portions are pivotal about a common axis.

23. The barricade of claim 22, wherein:
(a) said first motor means extensible portion is biased into retraction for thereby biasing said plate into said blocking position.

24. The barricade of claim 22, wherein:
(a) said first and second motor means are disposed in spaced parallel relation.

25. The barricade of claim 21, wherein:
(a) a housing is mounted to and extends from said frame, and said motor means are positioned in said housing.

* * * * *